US008596762B2

(12) United States Patent
Lee et al.

(10) Patent No.: US 8,596,762 B2
(45) Date of Patent: Dec. 3, 2013

(54) INKJET PRINTHEAD AND METHOD OF MANUFACTURING THE SAME

(75) Inventors: Jeong-Ho Lee, Seoul (KR); Woo-Yong Sung, Seoul (KR); Tae-Woon Cha, Seoul (KR)

(73) Assignee: Samsung Display Co., Ltd., Yongin (KR)

( * ) Notice: Subject to any disclaimer, the term of this patent is extended or adjusted under 35 U.S.C. 154(b) by 0 days.

(21) Appl. No.: 13/557,175

(22) Filed: Jul. 24, 2012

(65) Prior Publication Data

US 2013/0127951 A1 May 23, 2013

(30) Foreign Application Priority Data

Nov. 17, 2011 (KR) ..... 10-2011-0120303

(51) Int. Cl.
*B41J 2/14* (2006.01)
*B41J 2/235* (2006.01)

(52) U.S. Cl.
USPC ..... 347/47; 347/50

(58) Field of Classification Search
USPC ..... 347/47, 50
See application file for complete search history.

(56) References Cited

U.S. PATENT DOCUMENTS

| | | | | |
|---|---|---|---|---|
| 3,132,962 | A * | 5/1964 | Seymour | 434/113 |
| 3,887,928 | A * | 6/1975 | Ohno et al. | 347/55 |
| 4,695,854 | A * | 9/1987 | Cruz-Uribe | 347/40 |
| 5,189,437 | A * | 2/1993 | Michaelis et al. | 347/47 |
| 6,644,786 | B1 | 11/2003 | Lebens | |
| 6,733,684 | B2 | 5/2004 | Silverbrook | |
| 7,465,030 | B2 | 12/2008 | Silverbrook | |
| 2003/0193545 | A1 * | 10/2003 | Boucher et al. | 347/50 |
| 2006/0243701 | A1 * | 11/2006 | Ono et al. | 216/27 |
| 2010/0103224 | A1 * | 4/2010 | Gerner et al. | 347/68 |
| 2010/0188628 | A1 * | 7/2010 | Kwak et al. | 349/124 |

* cited by examiner

*Primary Examiner* — Matthew Luu
*Assistant Examiner* — Alexander D Shenderov
(74) *Attorney, Agent, or Firm* — H.C. Park & Associates, PLC

(57) ABSTRACT

An inkjet printer head including a nozzle part, a driving part, a printing liquid supplying part, an adhesive and a leak preventing part. The nozzle part includes a first surface and a second surface opposite the first surface. A nozzle is formed in the first surface sprays a printing liquid. A receiving hole is formed in the second surface receives the printing liquid. The driving part is disposed on the second surface of the nozzle part and drives the nozzle part. The printing liquid supplying part supplies the printing liquid to the nozzle part. The adhesive bonds the printing liquid supplying part onto the second surface. The receiving hole is formed in the second surface. The leak preventing part is disposed between the printing liquid supplying part and the driving part. The leak preventing part is formed to cover an exposed surface of the adhesive.

18 Claims, 6 Drawing Sheets

INKJET PRINTHEAD AND METHOD OF MANUFACTURING THE SAME

CROSS-REFERENCE TO RELATED APPLICATION

This application claims priority from and the benefit of Korean Patent Application No. 10-2011-0120303, filed on Nov. 17, 2011, which is hereby incorporated by reference for all purposes as if fully set forth herein.

BACKGROUND

1. Field

Exemplary embodiments of the present invention relate to an inkjet printer head and a method of manufacturing the inkjet printer head. More particularly, exemplary embodiments of the present invention relate to an inkjet printer head using micro electro mechanical systems (MEMS) and a method of manufacturing the inkjet printer head.

2. Discussion of the Background

An industrial inkjet printer uses metal, such as copper, gold, silver etc., and ceramic and polymer as well as dye. A method of direct printing a substrate, a film, fabric, a display apparatus, etc., has been used for printing an industrial graphic display apparatus, a display apparatus, a solar cell and etc. An inkjet printer has been used to form a color filter and an alignment layer for aligning liquid crystals.

A printer head having various characteristics such as high resolution and high reliability is required for the industrial inkjet printer. Accordingly, technology for the inkjet printer head using small electric elements has been developed.

However, the chemical resistance of small electric elements of the inkjet printer head is poor. Thus, chemicals used for printing liquid may deteriorate a driving circuit of the printer head. For example, the small electric elements of the inkjet printer head are attached to other elements using adhesive. The printing liquid may leak towards the small electric elements attached to the other elements through the adhesive, so that the electric characteristics of the driving circuit of the elements may be degraded In addition, N-methyl2-pyrrolidone (NMP), which is a kind of polyimide solvent used for aligning liquid crystal, may dissolve an anisotropic conductive film that connects the driving circuit to the other elements, so that the printer head may be deteriorated.

SUMMARY OF THE INVENTION

Exemplary embodiments of the invention provide an inkjet printer head having improved chemical resistance and protecting the driving circuit of the printer head from a printing liquid.

Exemplary embodiments of the invention also provide a method of manufacturing the inkjet printer head.

Additional features of the invention will be set forth in the description which follows, and in part will be apparent from the description, or may be learned by practice of the invention.

An exemplary embodiment of the present invention discloses an inkjet printer head including a nozzle part, a driving part, a printing liquid supplying part, an adhesive and a leak preventing part. The nozzle part includes a first surface and a second surface opposite the first surface. A nozzle is formed on the first surface and sprays a printing liquid. A receiving hole is formed on the second surface and receives the printing liquid. The driving part is disposed on the second surface of the nozzle part and drives the nozzle part. The printing liquid supplying part supplies the printing liquid to the nozzle part. The adhesive bonds the printing liquid supplying part onto the second surface. The receiving hole is formed through the second surface. The leak preventing part is disposed between the printing liquid supplying part and the driving part. The leak preventing part is formed to cover an exposed surface of the adhesive.

An exemplary embodiment of the present invention also discloses a method of manufacturing an inkjet printer head including forming a nozzle part having a first surface and a second surface opposite the first surface, forming a driving part driving the nozzle part, bonding a printing liquid supplying part onto the second surface, and forming a leak preventing part to cover an exposed surface. The nozzle is formed on the first surface and sprays a printing liquid. The receiving hole is formed on the second surface and receives the printing liquid. The driving part is disposed on the second surface of the nozzle part. The receiving hole is formed on the second surface using an adhesive. The printing liquid supplying part supplies the printing liquid to the nozzle part.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
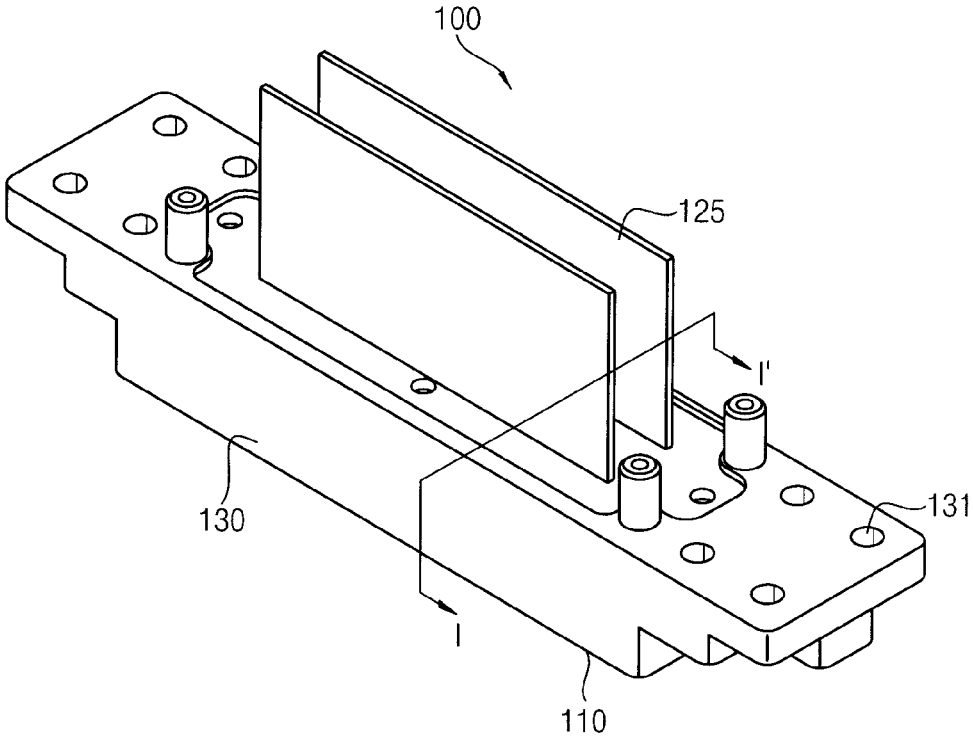
FIG. 1 is a perspective view illustrating a inkjet printer head according to a first exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present. It will be understood that for the purposes of this disclosure, "at least one of X, Y, and Z" can be construed as X only, Y only, Z only, or any combination of two or more items X, Y, and Z (e.g., XYZ, XYY, YZ, ZZ).

Figure 2:
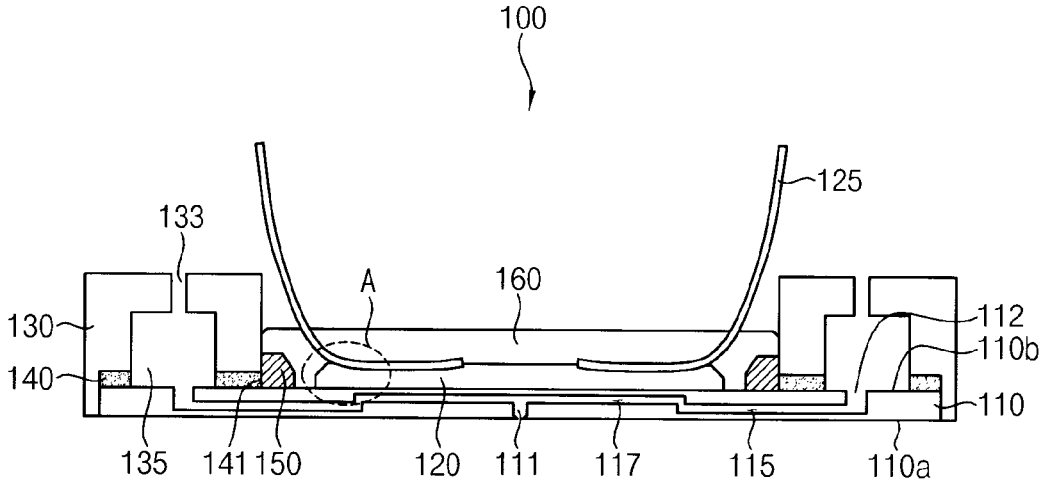
FIG. 2 is a cross-sectional view taken along a line I-I' of FIG. 1.

FIG. 1 is a perspective view illustrating an inkjet printer head according to an exemplary embodiment of the present invention. FIG. 2 is a cross-sectional view taken along a line I-I' of FIG. 1.

Referring to FIGS. 1 and 2, an inkjet printer head 100 according to the present exemplary embodiment includes a nozzle part 110, a driving part 120, a printing liquid supplying part 130, an adhesive 140 and a leak preventing part 150.

The nozzle part 110 includes a first surface 110*a* in which a nozzle 111 spraying a printing liquid is formed, and a second surface 110*b* opposite the first surface 110*a*. A receiving hole 112 receiving the printing liquid is formed in the second surface 110*b*. The nozzle part 110 may have a plate shape. The nozzle part 110 may include a flow path 115 through which the printing liquid flows, and a micro electro mechanical systems (MEMS) device having a chamber to receive the printing liquid. The printing liquid is filled in the chamber through the flow path 115. For example, the nozzle part 110 may be a MEMS chip. The first surface 110*a* may be a lower surface of the MEMS chip, and the second surface 110*b* may be an upper surface of the MEMS chip.

The printing liquid is received in the chamber 117 through the flow path 115 of the nozzle part 110. When the driving part 120 presses the chamber 117, the printing liquid is sprayed through the nozzle 111, so that the inkjet printer head performs printing. The driving part 120 may include a piezoelectric element, so that the chamber 117 may be pressed by the piezoelectric element. The nozzle 111 may be formed in a central region of the first surface 110*a*. In addition, a plurality of nozzles 111 may be formed in the central region of the first surface 110*a*.

The chamber 117 is disposed on the nozzle 111 in the central region of the first surface 110*a*. The receiving hole 112 may be formed in a peripheral region of the second surface 110*b*. A plurality of receiving holes 112 may be formed in the peripheral region of the second surface 110*b*. The flow path 115 connects the receiving hole 112 to the chamber 117. The printing liquid supplying part 130 supplies the printing liquid to the chamber 117 through the flow path 115. Alternatively, the nozzle part 110 may have various shapes. Many modifications of the nozzle part may be possible.

The driving part 120 is disposed on the second surface 110*b* of the nozzle part 110 and drives the nozzle part 110. The driving part 120 may be disposed in a central region of the second surface 110*b* opposite the first surface 110*a* to control the nozzle 111 formed in the central region of the first surface 110*a* of the nozzle part 110. The driving part 120 may include a circuit having a plurality of transistors, resistors, capacitors, etc., on a substrate. The driving part 120 may include a piezoelectric element 121 (shown in FIG. 3) and a flexible printed circuit board 125 applying a voltage to the piezoelectric element. A detailed explanation about the driving part 120 will be provided with reference to FIG. 3.

The printing liquid supplying part 130 supplies the printing liquid to the nozzle part 110. The printing liquid may include a liquid crystal alignment agent, such as polyimide. The printing liquid supplying part 130 may include a receiving part 135 receiving the printing liquid therein and an entrance 133 through which the printing liquid flows to receiving part 135.

The printing liquid supplying part 130 may be disposed in the peripheral region of the second surface 110*b* of the nozzle part 110. Thus, the printing liquid may be supplied to the chamber 117 through the receiving hole 112. The receiving hole 112 is formed through the second surface 110*b* of the nozzle part 110 and connects with the flow path 115. The printing liquid supplying part 130 may cover a side of the nozzle part 110. The printing liquid supplying part 130 may include a connector 131 connecting the inkjet printer head 100 to a printer body (not shown).

The printing liquid supplying part 130 covers an outer surface of the nozzle part 110 and the driving part 120 to protect the nozzle part 110 and the driving part 120. For example, the printing liquid supplying part 130 may include epoxy resin, silicon resin, etc. For example, the printing liquid supplying part 130 may have a bezel shape.

The adhesive 140 fixes the printing liquid supplying part 130 onto the second surface 110*b* of the nozzle part 110. The receiving hole 112 is formed through the second surface 110*b*. Thus, the adhesive 140 is disposed between the nozzle part 110 and the printing liquid supplying part 130. The printing liquid supplying part 130 is attached to the second surface 110*b* of the nozzle part 110 using the adhesive 140. The adhesive 140 may have various thicknesses. Alternatively, the adhesive 140 may have a constant thickness. In addition, an exposed surface 141 of the adhesive 140 makes contact with the driving part 120. An area between the exposed surface 141 of the adhesive 140 and the driving part 120 is substantially proportional to the thickness of the adhesive 140. The adhesive 140 may include epoxy type adhesive, silicon type adhesive, etc.

The leak preventing part 150 is disposed between the printing liquid supplying part 130 and the driving part 120. The leak preventing part 150 covers the exposed surface 141 of the adhesive 140, so that the printing liquid in the printing liquid supplying part 130 may not leak from the printing liquid supplying part 130 toward the driving part 120. The leak preventing part 150 forms as a barrier between the adhesive 140 and the driving part 120. Thus, the printing liquid in the printing liquid supplying part 130 may not pass through the adhesive 140 towards the driving part 120. The leak preventing part 150 may have a sufficient thickness to entirely cover the exposed surface 141 of the adhesive 140. The thickness of the leak preventing part 150 may be greater than the thickness of the adhesive 140.

For example, the printing liquid may be a liquid crystal alignment agent including polyimide that may be harmful to the driving circuit of the driving part 120. When the printing liquid leaks through the exposed surface 141 of the adhesive 140 towards the driving part 120, the driving circuit of the driving part 120 may be deteriorated. In addition, when the polyimide solvent used for the alignment process includes N-methyl2-pyrrolidone (NMP) leaks through the exposed surface 141 of the adhesive 140 towards the driving part 120, the driving circuit of the driving part 120 may be damaged. However, the printer head of the present invention includes the leak preventing part 150 to prevent the leakage of the printing liquid and the deterioration of the driving circuit of the driving element.

In the present embodiment, the leak preventing part 150 may include polyethylene. Resin including Polyethylene, polypropylene, nylon, polyethylene terephthalte (PET), etc., is insoluble to the liquid crystal alignment. The polyethylene may be used at a low processing temperature. If the leak preventing part 150 is formed at a high temperature, the driving part 120 may be damaged.

In addition, when the driving part 120 includes the piezoelectric element, the piezoelectric element may be depolarized at the high temperature. The de-poling of the piezoelectric element may occur at the high temperature. Generally, an insoluble material that is insoluble to the liquid crystal alignment agent may have a melting point of more than about 200° C. However, the polyethylene has a melting point about 130° C., so that electric characteristics of the driving part 120 may be degraded. In the present exemplary embodiment, the leak preventing part 150 having the polyethylene may be formed at the low temperature so that the electric characteristics of the driving part 120 may not be degraded. High density polyethylene (HDPE) has a high electric insulation value and high chemical resistance.

The printing liquid supplying part 130 may be spaced apart from the driving part 120 to form a gap in which the leak preventing part 150 may be disposed. In the present embodiment, the gap for the leak preventing part 150 may be about 2 mm. A plurality of the leak preventing parts 150 may be formed between the printing liquid supplying part 130 and the driving part 120. The leak preventing part 150 may have various shapes.

In addition, the inkjet printer head 100 may further include a passivation layer 160 covering the leak preventing part 150 and the driving part 120. The passivation layer 160 is formed on the second surface 110*b* of the nozzle part 110 to cover the driving part 120, so that the passivation layer 160 protects the driving part 120 from external impact. The passivation layer 160 may be formed by a molding process of epoxy resin, silicon resin, etc. Alternatively, the passivation layer 160 may include polyethylene that is substantially the same material as the leak preventing part 150.

Accordingly, the inkjet printer head 100 according to the present exemplary embodiment includes the leak preventing part 150 to prevent the leakage of the printing liquid from the printing liquid supplying part 130. The leak preventing part 150 protects the driving part 120 so that reliability and chemical resistance of the inkjet printer head 100 may be improved.

Figure 3:
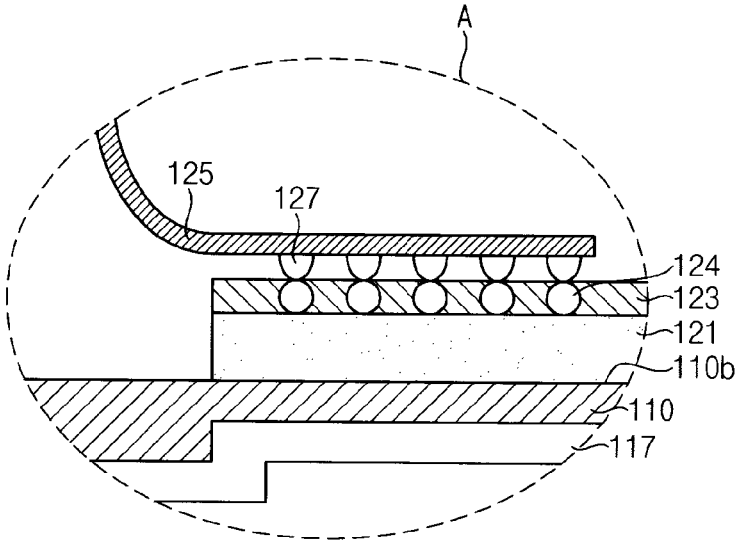
FIG. 3 is a partial enlarged cross-sectional view illustrating a portion 'A' of FIG. 2.

FIG. 3 is a partial enlarged cross-sectional view illustrating a portion 'A' of FIG. 2.

Referring to FIG. 3, the driving part 120 may include a piezoelectric element 121, an anisotropic conductive film 123 and a flexible printed circuit board 125.

The piezoelectric element 121 generates mechanical energy in response to a driving voltage applied to the piezoelectric element 121. The piezoelectric element 121 presses the chamber 117 using mechanical energy. Alternatively, when the piezoelectric element 121 is deformed by external force, an electric polarization may be formed in the piezoelectric element 121. The piezoelectric element 121 is disposed in the central region of the second surface 110*b* of the nozzle part 110. The piezoelectric element 121 transmits the mechanical energy generated in response to the driving voltage to the nozzle part 110. When the piezoelectric element 121 presses the chamber 117 filled by the printing liquid, the printing liquid may be squeezed out through the nozzle 111. Thus, the nozzle part 110 sprays the printing liquid through the nozzle 111, to perform printing. For example, the piezoelectric element 121 may include rochelle salt, barium titanate, etc. Rochelle salt and barium titanate both have a relatively high piezoelectric effect.

An anisotropic conductive film 123 is disposed between the flexible printed circuit board 125 and the piezoelectric element 121. The anisotropic conductive film 123 may include epoxy. The anisotropic conductive film 123 electrically and mechanically connects driving circuits. In the present exemplary embodiment, the anisotropic conductive film 123 electrically connects the flexible printed circuit board 125 to the piezoelectric element 121.

The anisotropic conductive film 123 may include a plurality of conductive balls 124 electrically connected to a terminal 127 of the flexible printed circuit board 125. The conductive balls 124 of the anisotropic conductive film 123 may have spherical shapes. One side of the conductive balls 124 makes contact with an upper surface of the piezoelectric element 121. Another side of the conductive balls 124 makes contact with the terminal 127 of the flexible printed circuit board 125 so that an electrical signal line may be formed between the flexible printed circuit board 125 and the piezoelectric element 121 through the conductive balls 124. For example, the conductive balls 124 may include a conductive material, such as copper (Cu), aluminum (Al), etc.

The flexible printed circuit board 125 applies the driving voltage to the nozzle part 110 to drive the nozzle part 110. In the present exemplary embodiment, the nozzle part 110 may include a MEMS device. Thus, the flexible printed circuit board 125 applies the driving voltage to the MEMS device of the nozzle part 110 to drive the MEMS device of the nozzle part 110. The piezoelectric element 121 generates mechanical energy in response to a driving voltage applied to the piezoelectric element 121. The flexible printed circuit board 125 includes a flexible film. A circuit is formed on the flexible film of the flexible printed circuit board 125. The flexible printed circuit board 125 includes a heat-resistance plastic film. For example, the heat-resistance plastic film may include polyester (PET), polyimide (PI), etc. The inkjet printer head 100 (shown in FIG. 2) may further include a plurality of the flexible printed circuit boards 125. In the present exemplary embodiment, the inkjet printer head 100 (shown in FIG. 2) includes two printing liquid supplying parts 130 that are formed on both sides of the nozzle 111. Thus, the inkjet printer head 100 (shown in FIG. 2) includes two flexible printed circuit boards 125 to control the printing liquid supplied from the two printing liquid supplying parts 130.

The flexible printed circuit board 125 may include terminal 127 that is electrically connected to the anisotropic conductive film 123. The terminal 127 may be electrically and mechanically connected to an external device, and the flexible printed circuit board 125 may be mounted to the external device. For example, the terminal 127 may include a conductive material. The conductive material of the terminal may include copper (Cu), aluminum (Al), etc.

Figure 4:
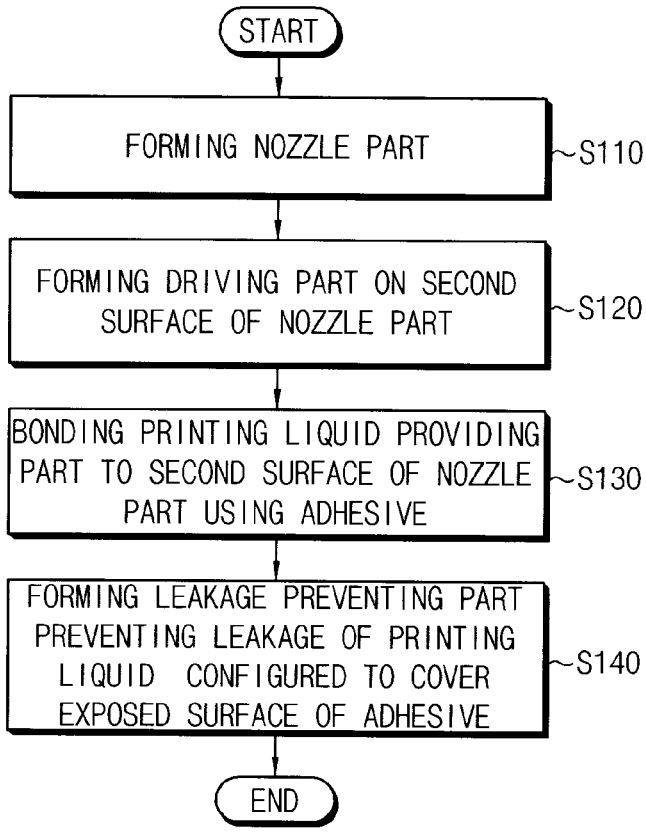
FIG. 4 is a flow chart illustrating a method of manufacturing the inkjet printer head of FIG. 1.

FIG. 4 is a flow chart illustrating a method of manufacturing the inkjet printer head of FIG. 1. FIGS. 5 to 8 are cross-sectional views illustrating the method of manufacturing the inkjet printer head of FIG. 4.

Figure 5:
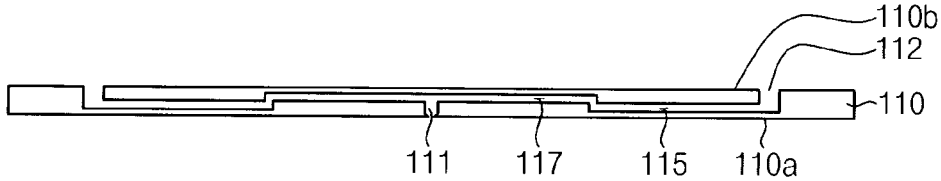
FIGS. 5, 6, 7, and 8 are cross-sectional views illustrating the method of manufacturing the inkjet printer head of FIG. 4.

Referring to FIGS. 4 to 5, a nozzle part 110 of the inkjet printer head 100 is formed (S110). The nozzle part includes a first surface 110*a* and a second surface 110*b* opposite the first surface 110*a*. The nozzle 111 spraying a printing liquid is formed on the first surface 110*a*. A receiving hole 112 receiving the printing liquid is formed on the second surface 110*b* (S110). The nozzle part 110 may have a plate shape. The nozzle part 110 may include a flow path 115 and a MEMS device. The printing liquid flows through the flow path 115. The MEMS device has a chamber 117, and receives the printing liquid through the flow path 115. For example, the nozzle part 110 may be a MEMS chip. The first surface 110*a* may be a lower surface of the MEMS chip, and the second surface 110*b* may be an upper surface of the MEMS chip.

The printing liquid is received in the chamber 117 through the flow path 115 of the nozzle part 110. When the driving part 120 presses the chamber 117, the nozzle part 110 sprays the printing liquid through the nozzle 111. Thus, the inkjet printer head performs printing. The driving part 120 may include a piezoelectric element, so that the chamber 117 may be pressed by the piezoelectric element. The nozzle 111 may be formed in a central region of the first surface 110*a*. In addition, a plurality of nozzles 111 may be formed in the central region of the first surface 110*a*.

The chamber 117 is disposed on the nozzle 111 in the central region of the second surface 110*b* of the nozzle part 110. The receiving hole 112 may be formed in a peripheral region of the second surface 110*b* of the nozzle part 110. A plurality of receiving holes 112 may be formed on the second surface 110*b* of the nozzle part 110. The flow path 115 connects the receiving hole 112 to the chamber 117. The printing liquid supplying part 130 supplies the printing liquid to the chamber 117 through the flow path 115. Alternatively, the nozzle part 110 may have various shapes. Many modifications of the nozzle part are possible.

Figure 6:
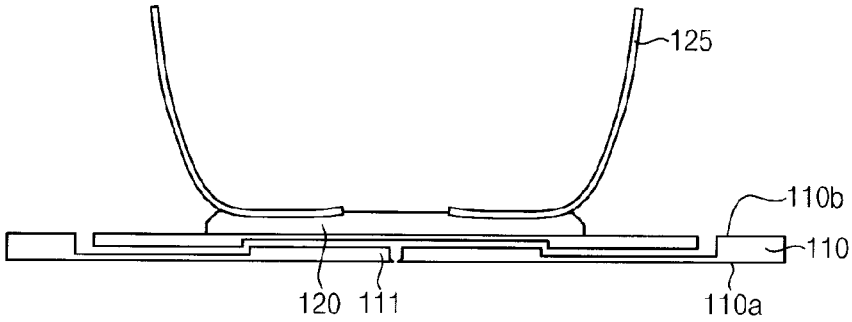

Referring to FIGS. 4 and 6, a driving part 120 of the inkjet printer head 100 is formed on the second surface 110*b* of the nozzle part (S120). The driving part 120 drives the nozzle part 110. The driving part 120 may be disposed in the central region of the second surface 110*b* to control the nozzle 111. The second surface 110*b* is opposite to the first surface 110*a*. The nozzle 111 of the nozzle part 110 is formed in the central region of the first surface 110*a*. The driving part 120 may include a piezoelectric element 121, an anisotropic conductive film 123 (shown in FIG. 3) and a flexible printed circuit board 125.

Figure 7:
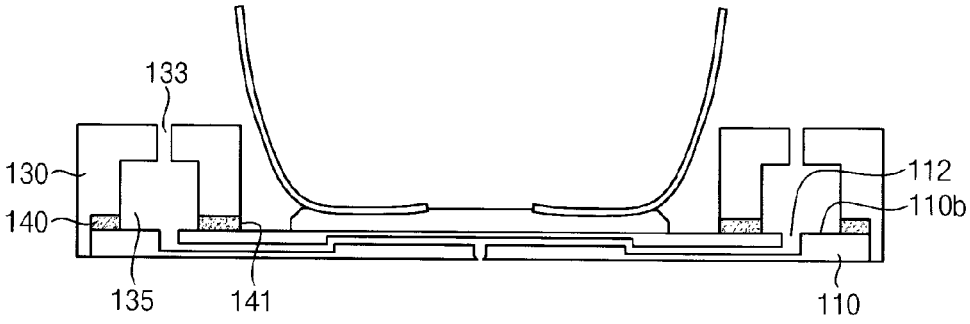

Referring to FIGS. 4 and 7, the printing liquid supplying part 130 of the inkjet printer head 100 is bonded on the second surface 110*b* of the nozzle part 110 using an adhesive 140 (S130). The printing liquid supplying part 130 supplies the printing liquid to the nozzle part 110. The receiving hole 112 is formed on the second surface 110*b* of the nozzle part 110. The printing liquid may include liquid crystal alignment agent. The liquid crystal alignment agent may include polyimide.

The printing liquid supplying part 130 may include a receiving part 135 and an entrance 133. The receiving part 135 of the printing liquid supplying part 130 receives the printing liquid. The printing liquid flows to receiving part 135 through the entrance 133. The printing liquid supplying part 130 surrounds the nozzle part 110 and the driving part 120 to form an outer portion of the inkjet printer head 100. For example, the printing liquid supplying part 130 may include epoxy resin, silicon resin, etc. For example, the printing liquid supplying part 130 may have a bezel shape.

The adhesive 140 fixes the printing liquid supplying part 130 onto the second surface 110*b* of the nozzle part 110. The receiving hole 112 is formed through the second surface 110*b*. Thus, the adhesive 140 is disposed between the nozzle part 110 and the printing liquid supplying part 130. The printing liquid supplying part 130 is attached to the second surface 110*b* of the nozzle part 110 using the adhesive 140. The adhesive 140 may have various thicknesses. Alternatively, the adhesive 140 may have a constant thickness. In addition, an exposed surface 141 of the adhesive 140 makes contact with the driving part 120. An area between the exposed surface 141 of the adhesive 140 and the driving part 120 is substantially proportional to the thickness of the adhesive 140. The adhesive 140 may include an epoxy-type adhesive, a silicon-type adhesive, etc.

Figure 8:
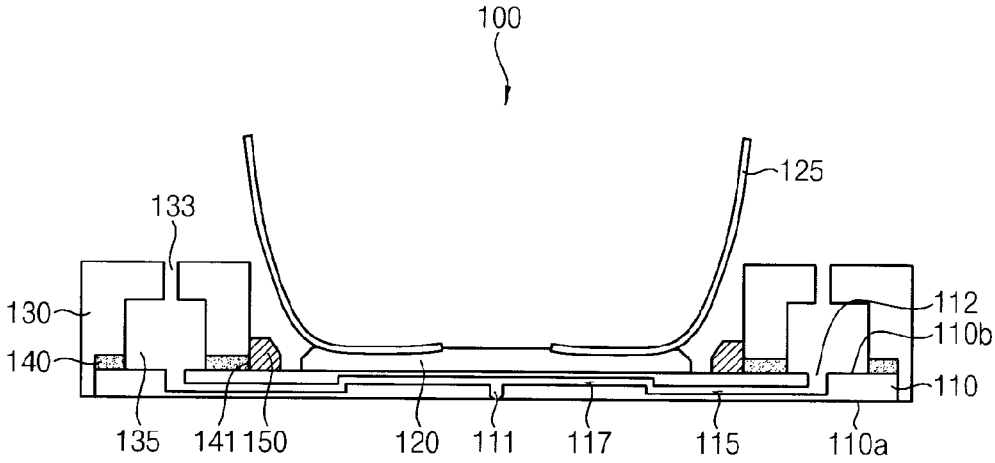

Referring to FIGS. 4 and 8, the method of manufacturing the inkjet printer head 100 further includes forming a leak preventing part 150 covering the exposed surface 141of the adhesive for preventing from a leakage of the printing liquid the printing liquid (S140). Thus, the leak preventing part 150 forms as a barrier between the adhesive 140 and the driving part 120. Thus, the printing liquid in the printing liquid supplying part 130 may not pass through the adhesive 140 towards the driving part 120. The leak preventing part 150 may have a sufficient thickness to entirely cover the exposed surface 141 of the adhesive 140. The thickness of the leak preventing part 150 may be greater than the thickness of the adhesive 140.

In addition, the method of manufacturing the inkjet printer head 100 may further include forming a passivation film 160 (shown in FIG. 2) covering the leak preventing part 150 and the driving part 120. The passivation layer 160 (shown in FIG. 2) is formed on the second surface 110*b* of the nozzle part 110 to cover the driving part 120, so that the passivation layer 160 (shown in FIG. 2) protects the driving part 120 from an external impact. The passivation layer 160 (shown in FIG. 2) may be formed by a molding process of epoxy resin, silicon resin, etc. Alternatively, the passivation layer 160 (shown in FIG. 2) may include polyethylene which is the same material as the polyethylene of the leak preventing part 150.

Figure 9:
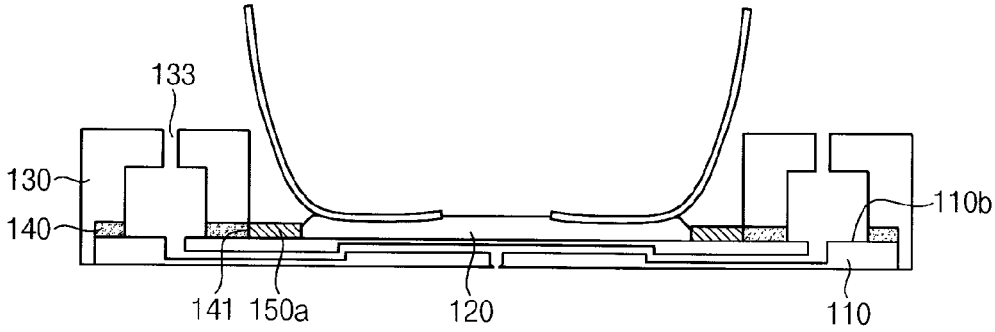
FIG. 9 is a cross-sectional view illustrating a method of manufacturing an inkjet printer head according to a second exemplary embodiment of the present invention.

FIG. 9 is a cross-sectional view illustrating a method of manufacturing an inkjet printer head according to a second exemplary embodiment of the present invention.

Referring to FIG. 9, after spreading a polyethylene powder on the second surface 110*b* of the nozzle part 110, the leak preventing part 150*a* may be formed by a plastic molding. The polyethylene powder may have a sufficient thickness to entirely cover the exposed surface 141 of the adhesive 140.

In addition, the method of manufacturing the inkjet printer head 100 may further include forming a passivation film 160 covering the leak preventing part 150*a* and the driving part 120. The passivation layer 160 is formed on the second surface 110*b* of the nozzle part 110 to cover the driving part 120, so that the passivation layer 160 protects the driving part 120 from an external impact. The passivation layer 160 may be formed by a molding process of epoxy resin, silicon resin, etc. Alternatively, the passivation layer 160 may include polyethylene that is substantially the same material as the leak preventing part 150.

Each of the steps illustrated in FIG. 4 may have many variations and modifications.

Figure 10:
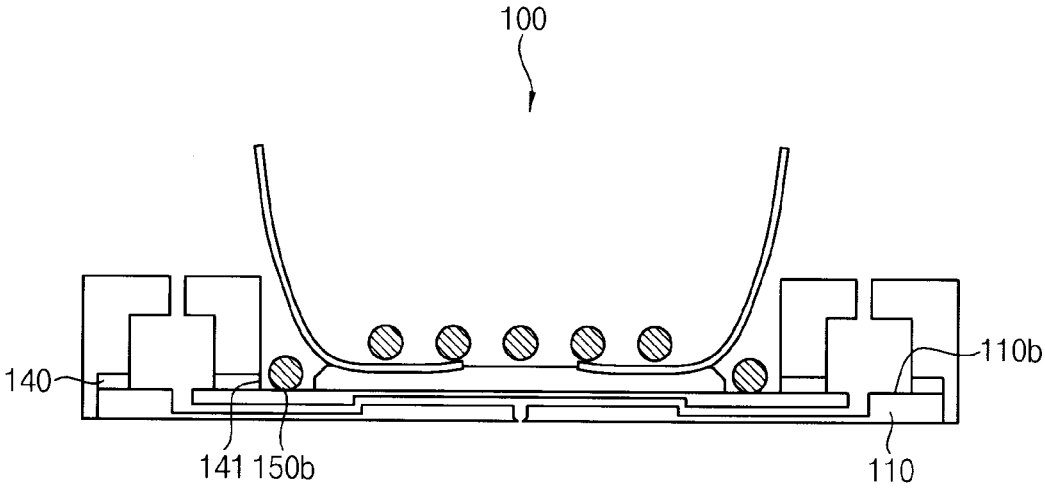
FIG. 10 is a cross-sectional view illustrating a method of manufacturing an inkjet printer head according to a third exemplary embodiment of the present invention.

FIG. 10 is a cross-sectional view illustrating a method of manufacturing an inkjet printer head according to a third exemplary embodiment of the present invention.

Referring to FIGS. 4 and 10, in a step of forming the leak preventing part 150*b* (step S140), a polyethylene bar may be formed adjacent to the exposed surface 141 of the adhesive 140 by injection molding on the second surface 110*b* of the nozzle part 110. The leak preventing part 150*b* may be formed by the plastic molding. A thickness of the leak preventing part 150*a* (shown in FIG. 9) formed by polyethylene powder may be uncontrollable and the leak preventing part 150*a* (shown in FIG. 9) formed by polyethylene powder may include bubbles. However, the thickness and position of the leak preventing part 150*b* formed by the polyethylene bar may be easily controlled, and bubbles may be prevented from being formed in the leak preventing part 150*b*.

The inkjet printer head 100 is the same as that described in the previous exemplary embodiment in FIG. 9 except for using the polyethylene bar 150*b* instead of the polyethylene powder 150*a* to form the leak preventing part 150. Any further repetitive explanation concerning the above elements will be omitted. In addition, the method of manufacturing the inkjet printer head 100 according to the present exemplary embodiment is substantially same as the method illustrated in FIGS. 4 to 7.

According to the exemplary embodiments of the present invention, a driving circuit of an inkjet printer head may be protected from being contaminated and damaged by a printing liquid, and a chemical resistance may be improved.

It will be apparent to those skilled in the art that various modifications and variations can be made in the present invention without departing from the scope of the invention. Thus, it is intended that the present invention cover the modifications and variations of this invention provided they come within the scope of the appended claims and their equivalents.

What is claimed is:

1. An inkjet printer head comprising:

a nozzle part comprising a first surface and a second surface opposite the first surface, a nozzle formed in the first surface and configured to spray a liquid, and a receiving hole formed in the second surface and configured to receive the liquid;

a driving part disposed on the second surface of the nozzle part and configured to drive the nozzle part;

a liquid supplying part configured to supply the liquid to the nozzle part;

an adhesive bonding the liquid supplying part onto the second surface; and a leak preventing part disposed between the liquid supplying part and the driving part to cover an exposed surface of the adhesive, wherein the leak preventing part comprises an injection molded polyethylene bar disposed adjacent to an exposed surface of the adhesive.

2. The inkjet printer head of claim 1, wherein the liquid comprises liquid crystal alignment agent comprising polyimide.

3. The inkjet printer head of claim 1, wherein the nozzle part comprises a flow path configured to permit a flow of the liquid, a micro electro mechanical systems (MEMS) device, and a chamber formed in the MEMS device configured to receive the liquid.

4. The inkjet printer head of claim 3, wherein the driving part comprises:

a printed circuit board configured to apply a driving voltage to the MEMS device;

a piezoelectric element configured to press the chamber in response to the driving voltage; and an anisotropic conductive film disposed between the printed circuit board and the piezoelectric element.

5. The inkjet printer head of claim 4, wherein the printed circuit board comprises a terminal electrically connected to the anisotropic conductive film.

6. The inkjet printer head of claim 5, wherein the anisotropic conductive film comprises a plurality of conductive balls.

7. The inkjet printer head of claim 5, wherein the driving part is disposed in a central region of the second surface of the nozzle part, and the liquid supplying part is disposed in a peripheral region of the second surface of the nozzle part.

8. The inkjet printer head of claim 1, further comprising a passivation film covering the leak preventing part and the driving part.

9. The inkjet printer head of claim 8, wherein the passivation film comprises polyethylene.

10. The inkjet printer head of claim 1, wherein a gap between the liquid supplying part and the driving part is greater than 2 mm.

11. A method of manufacturing an inkjet printer head comprising:

forming a nozzle part comprising a first surface and a second surface opposite the first surface, a nozzle formed in the first surface and configured to spray a liquid, and a receiving hole formed in the second surface and configured to receive the liquid;

forming a driving part disposed on the second surface of the nozzle part, the driving part configured to drive the nozzle part;

bonding a liquid supplying part onto the second surface using an adhesive, the liquid supplying part configured to supply the liquid to the nozzle part; and forming a leak preventing part covering an exposed surface of the adhesive, wherein forming the leak preventing part comprises:

spreading a polyethylene powder on the second surface of the nozzle part to cover the exposed surface of the adhesive; and plastic molding the polyethylene powder to form the leak preventing part.

12. The method of claim 11, wherein the nozzle part comprises a flow path configured to permit flow of the liquid, a MEMS device, and a chamber formed in the MEMS device configured to receive the liquid.

13. The method of claim 11, further comprising:

forming a passivation film covering the leak preventing part and the driving part.

14. The method of claim 13, wherein the passivation film comprises polyethylene.

15. The method of claim 12, wherein forming the driving part comprises:

disposing a piezoelectric element adjacent the chamber, the piezoelectric element configured to press the chamber in response to a driving voltage applied by a printed circuit board; and disposing an anisotropic conductive film between the printed circuit board and the piezoelectric element.

16. The method of claim 11, wherein forming the driving part further comprises disposing the driving part in a central region of the second surface of the nozzle part.

17. The method of claim 11, wherein bonding the printing liquid supplying part further comprises bonding the liquid supplying part in a peripheral region of the second surface of the nozzle part.

18. A method of manufacturing an inkjet printer head comprising:

forming a nozzle part comprising a first surface and a second surface opposite the first surface, a nozzle formed in the first surface and configured to spray a liquid, and a receiving hole formed in the second surface and configured to receive the liquid;

forming a driving part disposed on the second surface of the nozzle part, the driving part configured to drive the nozzle part;

bonding a liquid supplying part onto the second surface using an adhesive, the liquid supplying part configured to supply the liquid to the nozzle part; and forming a leak preventing part covering an exposed surface of the adhesive, wherein forming the leak preventing part comprises:

disposing a polyethylene bar formed by injection molding adjacent to the exposed surface of the adhesive; and plastic molding the polyethylene bar to form the leak preventing part.

* * * * *